United States Patent [19]

Yamamuro et al.

[11] Patent Number: 4,486,124

[45] Date of Patent: Dec. 4, 1984

[54] PIPE LAYING METHOD AND APPARATUS

[75] Inventors: Toshikazu Yamamuro, Odawara; Masami Shiotsubo; Hiroshi Saito, both of Hiratsuka, all of Japan

[73] Assignee: Kabushiki Kaisha Komatsu Seisakusho, Tokyo, Japan

[21] Appl. No.: 541,203

[22] Filed: Oct. 12, 1983

[51] Int. Cl.[3] ..... F16L 1/02

[52] U.S. Cl. ..... 405/184; 175/62; 405/248

[58] Field of Search ..... 405/184, 154, 303, 146, 405/138, 248, 249; 175/62, 53, 73; 254/29 R; 299/56

[56] References Cited

U.S. PATENT DOCUMENTS

| | | | |
|---|---|---|---|
| 3,589,135 | 6/1971 | Ede | 405/184 |
| 3,608,317 | 9/1971 | Landau | 405/248 |
| 3,845,828 | 11/1974 | Taylor et al. | 175/62 X |
| 3,916,634 | 11/1975 | Woodruff | 405/248 |
| 4,020,641 | 5/1977 | Takada | 405/184 |
| 4,024,721 | 5/1977 | Takada | 405/184 |
| 4,091,631 | 5/1978 | Cherrington | 175/62 X |
| 4,226,477 | 10/1980 | Capoccia | 175/62 X |
| 4,403,890 | 9/1983 | Miyanagi et al. | 405/184 |

*Primary Examiner*—Dennis L. Taylor

*Attorney, Agent, or Firm*—Armstrong, Nikaido, Marmelstein & Kubovcik

[57] ABSTRACT

A method and apparatus for laying a pipeline in the underground. First, a pilot pipeline of small diameter is laid in the underground between a departure pit and an arrival pit. A cutter head having a cutter drum mounted thereto is attached to the trailing end of the pilot pipeline. By rotating the cutter drum, earth and sand is excavated and taken in inside the cutter drum where earth and sand is converted into a slurry state by injecting therein water through a water supply pipe mounted to the pilot pipeline. The slurried earth and sand is then discharged through a slurry discharge pipe mounted to the pilot pipeline to a tank provided in the arrival pit. By actuating a propulsion jack installed in the departure pit, the cutter head is propelled into the underground and then a pipe to be laid is connected to the rear end of the cutter head. By repeating the excavation and the propulsion steps, a pipeline of a larger diameter is laid in the underground.

8 Claims, 5 Drawing Figures

PIPE LAYING METHOD AND APPARATUS

BACKGROUND OF THE INVENTION

This invention relates to a pipe laying method and apparatus wherein a pilot pipeline of a small diameter is accurately introduced and laid between a departure pit and an arrival pit and then pipes of intermediate diameters (say, 250–600 mmϕ) are laid.

In the conventional system, a pilot pipeline is laid underground, by means of a pilot head whose direction can be corrected, between a departure pit and an arrival pit, and subsequently a cutter head (which houses a hydraulic motor etc. taking into account the spaces available in the pits) having a pipe of an intermediate diameter attached thereto is mounted to the rear end of the pilot pipeline and then it is propelled underground by means of a propulsion jack. The earth and sand in front of the pipe of an intermediate diameter are excavated by the action of a cutter mounted on the cutter head so that they may be introduced therein and then conveyed by a screw conveyor mounted in the pilot pipeline to the arrival pit.

Subsequently, the earth and sand which have been transported and discharged will be recovered once into an excavated earth and sand recovery tank and then discharged aboveground.

The above system is described in U.S. Pat. Nos. 4,020,641, 4,024,741 and 4,026,371 and contents therein are incorporated herein by reference.

A problem associated with this system resides in that since the earth and sand are transported through the pilot pipes by the screw conveyor the inside surface of the pilot pipes will wear by abrasion heavily resulting in a reduction of the strength of the pilot pipes which tends to cause buckling of them when they are propelled.

This pipe laying method is further disadvantageous in that the screw conveyor tends to get clogged with the earth and sand so that a required torque cannot be developed thus making the propulsion of pipes to be laid underground impossible.

SUMMARY OF THE INVENTION

It is therefore an object of the present invention to provide a method and apparatus for laying a pipeline in the underground which overcomes the above noted problems of the prior art. Another object of the present invention is to provide a method and apparatus for laying a pipeline in the underground which can prevent an excessive wear of a pilot pipeline and also prevent the same from clogging with the earth and sand transported by a screw conveyor. A further object of the present invention is to provide a method and apparatus for laying a pipeline in the underground which can prevent a pit face from being caved-in by equalizing a pressure at the inside of a cutter drum to the underground pressure around the cutter drum.

In accordance with an aspect of the present invention, there is provided a method of laying a pipe in the underground comprising the steps of: digging a departure and a arrival pit in the underground; laying a pilot pipeline of small diameter across said departure pit and said arrival pit; attaching a cutter head to the trailing end of said pilot pipeline, said cutter head having a cutter drum mounted thereto at the leading end thereof, diameter of said cutter drum being larger than that of said pilot pipeline and about equal to the diameter of the pipe to be laid; excavating earth and sand by said cutter drum and taking excavated earth and sand into an inside chamber of said cutter drum; supplying water into the chamber by utilizing said pilot pipeline to thereby convert the excavated earth and sand into a slurry state; discharging the slurried earth and sand into a tank provided in the arrival pit by utilizing said pilot pipeline; pushing the trailing end of said cutter head by a propulsion jack installed in the departure pit to thereby push said cutter head into the underground; connecting a pipe to be laid to the trailing end of said cutter head; repeating the steps (d) to (f) above; and pushing the trailing end of said pipe to be laid by said propulsion jack to thereby push said pipe into the underground.

In accordance with another aspect of the present invention, there is provided an apparatus for laying a pipe in the underground, comprising: a pilot pipeline of a small diameter laid in the underground across a departure pit and a arrival pit; cutter head means connected to the trailing end of said pilot pipeline, said cutter head means including means for excavating earth and sand and taking excavated earth and sand therein, the pipe to be laid being connectible to the trailing end of said cutter head means; propulsion jack means installed in the departure pit to push the trailing end of said cutter head means or the trailing end of said pipe if connected to said cutter head means thereby propelling said cutter head means or a combination of said cutter head means and said pipe into the underground; a first tank containing water therein; water supply pipe means mounted to said pilot pipeline and connected to said first tank; means formed in said cutter head means for converting the taken-in excavated earth and sand into a slurry state with the aid of water supplied from said water supply pipe means; slurry discharge pipe means mounted to said pilot pipeline for discharging the slurried earth and sand from said cutter head means; a second tank for receiving the slurried earth and sand from said slurry discharge pipe means; and a first pump for pumping water from said first tank and supplying the same to said water supply pipe means.

The above and other objects, features and advantages of the present invention will be readily apparent from the following description taken in conjunction with the accompanying drawings.

DESCRIPTION OF THE PREFERRED EMBODIMENTS

Figure 1:
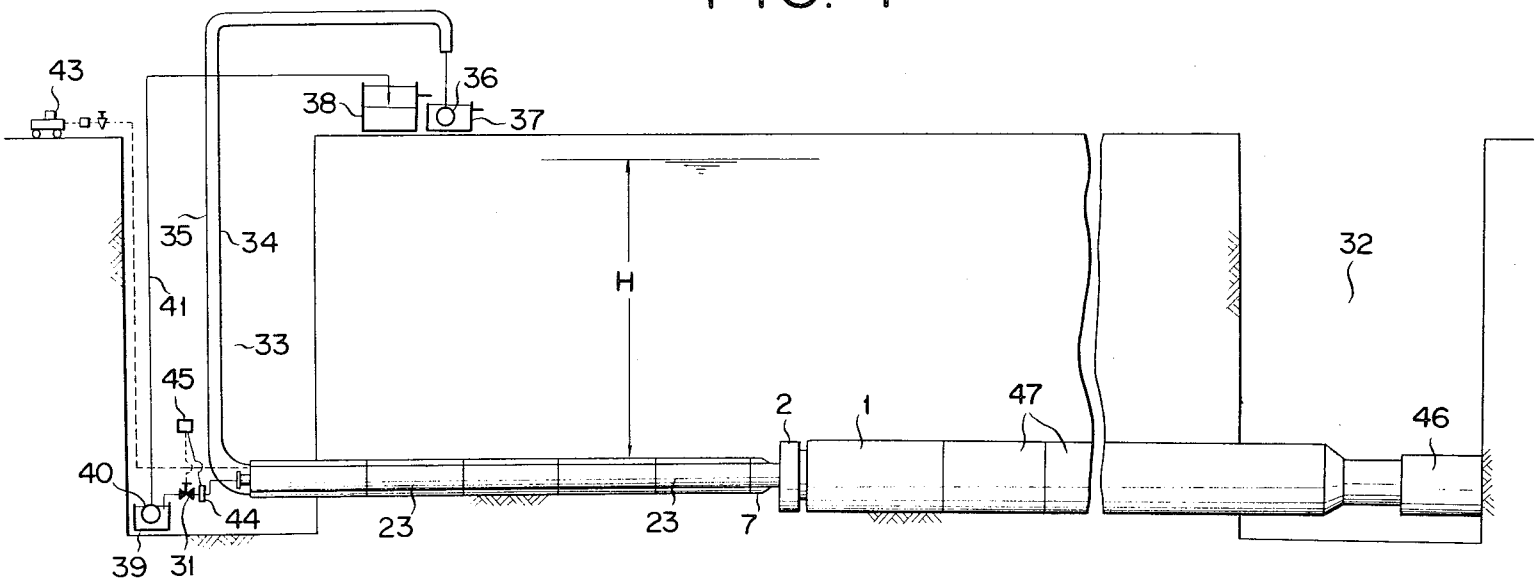
FIG. 1 is a schematic representation of a pipeline laying apparatus according to the present invention.
Figure 2:
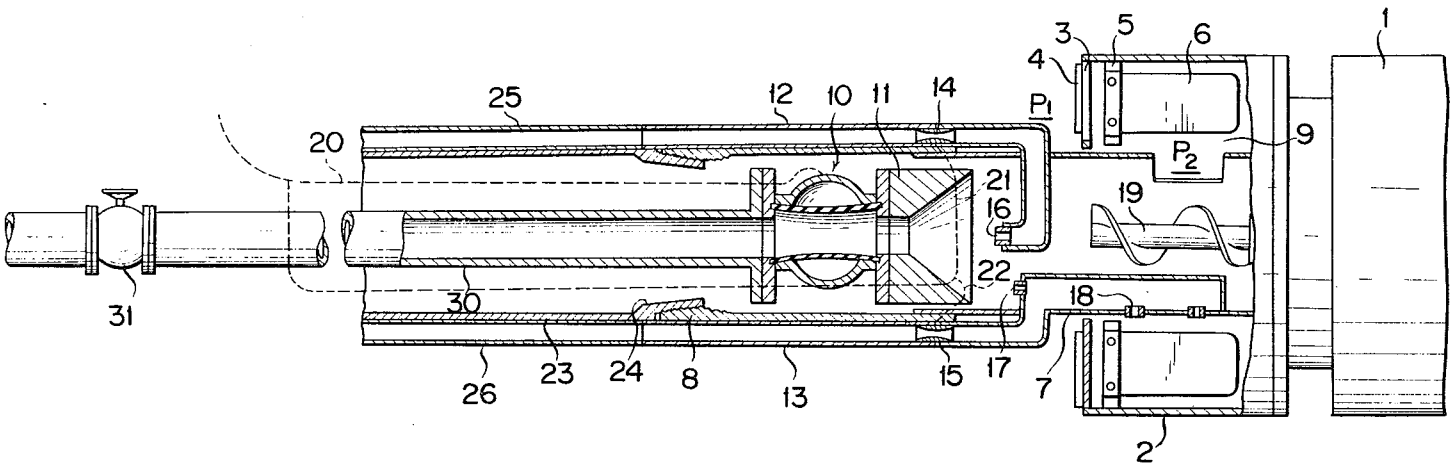
FIG. 2 is an enlarged sectional view of connecting section of a pilot pipeline and a cutter head.
Figure 3:
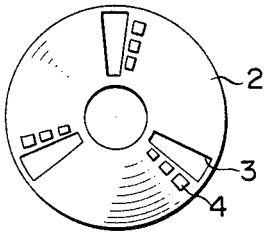
FIG. 3 is a front elevational view of a cutter drum mounted to the cutter head.

The present invention will now be described by way of example only with reference to the accompanying drawings.

In the drawings, reference numeral 1 denotes a cutter head which is provided with a cutter drum 2 at the front end thereof. The cutter drum 2 has an earth and sand intake port 3 and a cutter 4 located and mounted in the front end thereof. Further, the cutter drum 2 has agitator plates 6 fitted thereto through brackets 5.

In the drawings, reference numeral 7 denotes a connection pipe which passes through the cutter drum 2 and is connected to the cutter head 1. The connection pipe 7 has an intake port 9 and a screw-threaded portion 8 formed in the front end thereof.

Mounted within the connection pipe 7 is a pinch valve 10 for a slurry discharge pipe. A funnel shaped inlet pipe 11 is fitted to the rear end of the pinch valve 10 for use with slurry discharge pipe. Fitted to the outer periphery of the connection pipe 7 are a first water supply pipe 12 and a second water supply pipe 13. The water supply pipes 12 and 13 are provided with pinch valves 14 and 15, respectively. The rear portion of the first water feed pipe 12 is inserted in the connection pipe 7 and is provided with a slurry forcing nozzle 16. The rear portion of the second water supply pipe 13 is also inserted in the connection pipe 7 and is provided with a nozzle 17 for preventing precipitation of slurry and nozzles 18 for stirring slurry.

The slurry forcing nozzle 16 is located in alignment with the inlet pipe 11, and the nozzle 17 for preventing precipitation of slurry is located opposite to an edge of the inlet of the inlet pipe 11, whilst the slurry agitator nozzles 18 are directed to the inside of the cutter drum 2.

Rotatably mounted within the connection pipe 7 is a screw conveyor 19 to which a rotary driving power is transmitted by the cutter head 1.

The pinch valve 10 for slurry discharge pipe and the pinch valves 14 and 15 mounted in the water supply pipes 12 and 13, respectively, are supplied with the compressed air delivered by a compressor 43 installed on the ground surface through pipelines 20, 21 and 22, respectively.

In the drawings, reference numeral 23 denotes pilot pipes. The rearmost pilot pipe 23 has a connecting portion 24 adapted to be connected to the connecting portion or screw threaded portion 8 of the connection pipe 7. Fitted to the outer peripheral part of the pilot pipe 23 are a first water supply pipeline 25 connected to the first water supply pipe 12, and a second water supply pipeline 26 connected to the second water supply pipe 13.

In the drawings, reference numeral 30 denotes a slurry discharge pipe, the rear end of which is connected to the pinch valve 10 and the front end of which has a flow control valve 31 and a flowmeter 44 attached thereto. The flow control valve 31 and the flowmeter 44 are connected to a controller 45.

The operation of the apparatus according to the present invention will now be described below.

In the first place, in accordance with the method described in U.S. Pat. Nos. 4,020,641, 4,024,721 and 4,026,371, pilot pipes 23 of a small diameter are laid underground from a departure pit 32 to an arrival pit 33 by using a small diameter pipe propulsion system whose direction can be corrected (not shown), and subsequently the rearmost pilot pipe 23 is connected to the connection pipe 7 of the cutter head 1. In this case, the water supply pipelines 25 and 26 of the pilot pipe 23 are connected to the first water supply pipe 12 and the second water supply pipe 13, respectively. The water supply pipelines 25 and 26 are connected through pipelines 34 and 35 installed in the arrival pit 33 with the delivery side of a pump 36 installed above the ground. The pump 36 is installed in a water supply tank 37 which is supplied with water from a settling tank 38.

Further, the slurry discharge pipe 30 is inserted in the pilot pipeline 23 and is connected at one end thereof to the pinch valve 10. The slurry discharge pipe 30 is connected at the other end to an excavated earth and sand recovery tank 39.

Installed in the excavated earth and sand recovery tank 39 is a sand pump 40, the delivery side of which is connected through a pipe 41 to the settling tank 38.

The cutter head 1 is driven to rotate the cutter drum 2 to excavated the natural ground by the cutter 4 and a pipe 47 is propelled and laid underground by means of a propulsion jack 46.

The earth and sand excavated by the cutter 4 are taken through the intake port 3 into the cutter drum 2. The water supplied under pressure by the pump 36 into the second water supply pipe 13 is injected through the slurry agitator nozzles 18 onto the excavated earth and sand. Further, the earth and sand in the cutter drum 2 are agitated by the agitator plates 6 rotating with the cutter drum 2 so as to convert them into slurry.

The earth and sand in slurry state are supplied by the action of the screw conveyor 19 through the inlet pipe 11 and the pinch valve 10 into the slurry discharge pipe 30.

At that time, the excavated earth and sand under slurry condition is forced by the water injected through the slurry forcing nozzle 16 into the slurry discharge pipe 30.

Further, settlement or precipitation of the earth and sand in the inlet portion of the inlet pipe 11 is prevented by the water injected through the nozzle 17.

The earth and sand transported through the slurry discharge pipe 30 will flow into the excavated earth and sand recovery tank 39 and then sent under pressure into the settling tank 38 by the sand pump 40. The water which flows over the settling tank 38 flows into the water feed tank 37.

An excavation control method according to the invention will be described below.

Rotation of the cutter 4 excavates earth and sand, and the excavated earth and sand are taken into the cutter drum 2 and then changed into a slurry state by the action of the water supplied through the water supply pipe 13, the resultant slurry being discharged through the slurry discharge pipe 30. During the time, the slurry discharge quantity $Q_2$ is measured or detected by the flowmeter 44 and a detection signal generated by the flowmeter 44 is sent to the controller 45, the output signal of which controls the control valve 31 so that the slurry discharge quantity or return flow rate $Q_2$ may be kept approximately equal to the water supply quantity $Q_1$.

Stating in more detail, the pressure $P_2$ within the cutter drum 2 is controlled from the outside, and so a pressure loss will occur by restricting the control valve 31.

If we put $P_2 = \Delta P + Kl(Q_2)^2$ wherein $\Delta P$ is a pressure loss across the valve, $Kl(Q_2)^2$ is a pressure loss across the pipeline, where $$C_v = \frac{1.17Q_2}{\sqrt{\Delta P}}.$$

and l is the length of the pipeline;

we obtain $$P_2 = \left[ \frac{(1.17)^2}{(C_v)^2} + Kl \right] \times (Q_2)^2$$

Because the value of $C_v$ varies with the degree of opening of the control valve, if the control valve 31 is closed, then $\Delta P$ will increase resulting in an increase in pressure $P_2$. In this way the pressure $P_2$ within the cutter drum 2 can be controlled.

It is to be understood that, if $P_1$ is kept equal to $P_2$ to eliminate the pressure differential therebetween, then the flow of water as well as earth and sand from the natural ground into the inside of the cutter drum 2 will discontinue.

The detection of the pressure differential between $P_1$ and $P_2$, however, requires assembly of a differential pressure measuring instrument into the cutter head 1, and therefore a best result can be obtained by measuring the return flow rate $Q_2$ and shutting off the control valve 31 until the return flow rate $Q_2$ becomes approximately equal to the water supply quantity $Q_1$.

For this reason, if $Q_1$ becomes equal to $Q_2$, then $P_1$ becomes equal to $P_2$ thus enabling the soil excavation to be conducted at the theoretical excavation quantity. Further, if the opening degree of the control valve 31 is increased, then the quantity of earth and sand to be excavated will increase beyond the theoretical value, whilst the opening degree of the valve 31 is reduced, the quantity of earth and sand to be excavated will become less than the theoretical value.

Thus, if and when the slurry discharge quantity $Q_2$ is kept equal to the water supply quantity $Q_1$, then it is possible to take out the earth and sand in volume equivalent to the theoretical value. Therefore, it is only necessary to control the control valve 31 manually or automatically while monitoring the flowmeter 44 to thereby ensure that the slurry discharge quantity $Q_2$ becomes equal to the water supply quantity $Q_1$. Moreover, if the water supply quantity $Q_1$ is set equal to the slurry discharge quantity $Q_2$, then the supplied water is recycled so that the liquid level in the water supply tank 37 may be kept constant. Accordingly, controls of the opening degree of the control valve 31 while monitoring the liquid level in the water supply tank 37 enables the water supply quantity $Q_1$ to be kept equal to the slurry discharge quantity $Q_2$. When the concentration of the slurry is high, it is only necessary to make adjustments so as to obtain a relationship expressed by the following formula.

$$Q_2 = Q_1 + q$$

wherein q is a volumetric excavation flow rate (l/min), and its value is generally a few percents of $Q_1$ and is therefore negligible.

Further, the volumetric excavation flow rate q can be obtained by the product of the sectional area S of the cutter 4 of the cutter head 1 and the propulsion speed V.

According to the method of the present invention, when one pipe 47 to be laid underground has been propelled; in other words, one pilot pipe 23 has been pushed and exposed in the arrival pit 33, the most forward pilot pipe 23 is dismantled, whilst in the departure pit 32 another pipe 47 to be laid underground is connected and then propelled again. When the leading pilot pipe 23 is dismantled, the water supply pipelines 25, 26 and the slurry discharge pipe 30 are opened into the surrounding air.

When the underground water head H is high, for example, 3 to 6 meters, a pressure of 0.3 to 0.6 kg/cm$^2$ is exerted at the earth and sand intake part 3 so that the underground water flows into the cutter drum 2.

The soil having a completely self-supporting property will not enter the intake port 3, but sandy soils have no self-supporting characteristic and flow into the cutter drum through the intake port 3 with the water flow.

Further, when the underground water head is high, for example, about 6 meters, the earth and sand are forced through the slurry discharge pipe 30 into the arrival pit 33. Thus, the earth and sand are removed from the underground even when the pipes are not propelled, and therefore there is a risk of occurrence of land subsidence.

Further, in case the water head is low, say, about 3 meters, it becomes difficult to force slurried earth and sand through the slurry discharge pipe 30 so that the pipe 30 tends to get clogged with settled earth and sand thereby making propulsion of the pipe to be laid underground impossible.

To eliminate such difficulties compressed air is supplied into the pinch valves 14 and 15 mounted within the first and second water supply pipes 12, 13 and the pinch valve 10 for slurry discharge pipe 30 thereby stopping invasion of water.

Figure 4:
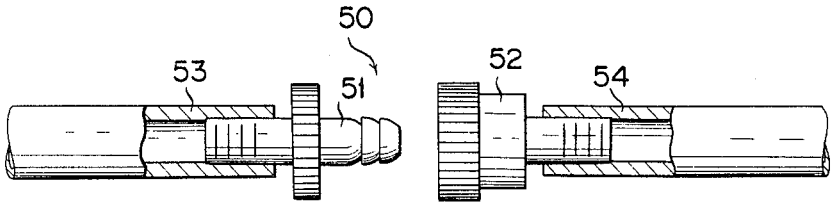
FIG. 4 is a view, partly in section, explanatory of the joint of two hoses.

Further, the pipeline 20 extending from the compressor 43 to the pinch valves 10, 14 and 15 may be provided with a lock type joint 50 as shown in FIG. 4 to enable the pipeline 20 to be connected and disconnected as desired.

If, in the joint 50, a male fitting 51 of a hose 53 on the compressor side is allowed to enter a female fitting 52 of a hose 54 on the side of the pinch valves, then the two parts of the pipeline 20 are connected, whilst if the male fitting 51 is withdrawn from the female fitting 52, the latter is shut off so that a pressure may be maintained in the lines in which the pinch valves 10, 14 and 15 are installed.

The above-mentioned joint 50 may be used for water supply pipelines 34 and 35 and the slurry transport pipeline 41, respectively.

If the underground water does not flow into the water supply pipelines 25 and 26 and the slurry discharge pipe 30, then no movement of earth and sand occurs, and so the aforementioned problem will not occur.

As can be seen from the foregoing, by closing the pinch valve 10 for the slurry discharge pipe 30 and the pinch valves 14 and 15 for water supply pipes 12 and 13, when another pipe 47 to be laid is connected and the leading pilot pipe 23 is removed, it becomes possible to prevent invasion of underground water through the earth and sand intake port even if the underground water head is high and also prevent invasion of the earth and sand as well.

Figure 5:
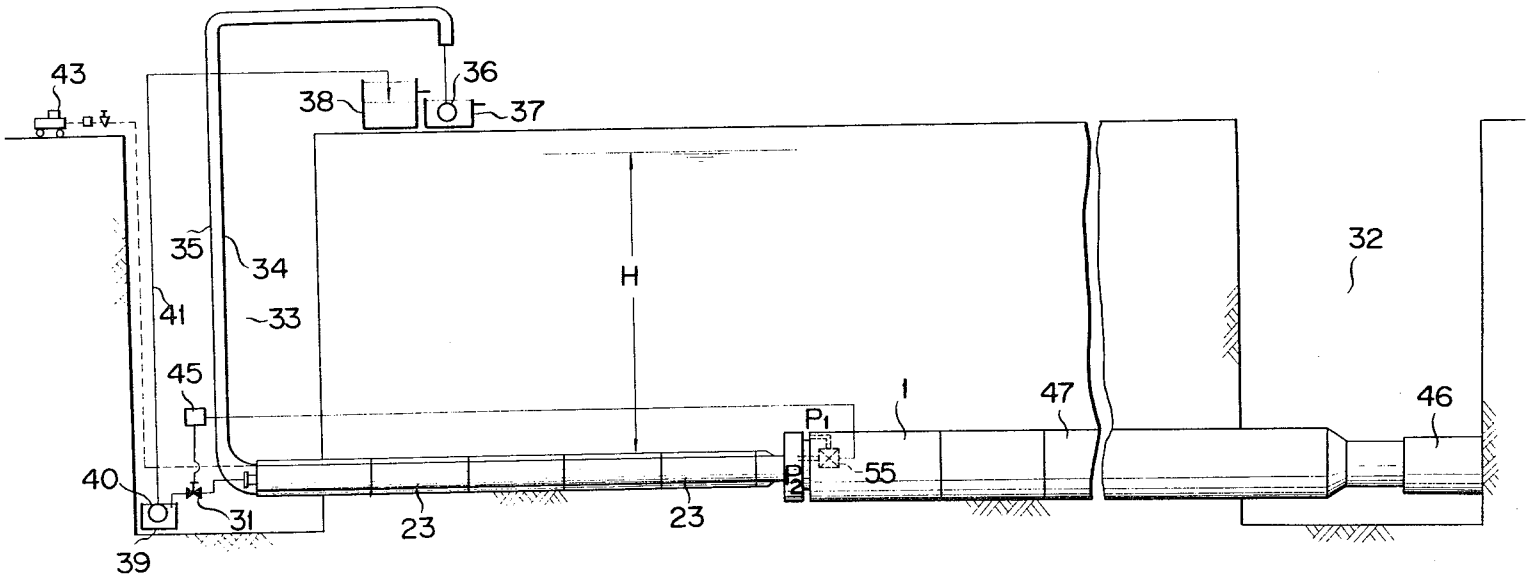
FIG. 5 is similar to FIG. 1 but showing another embodiment of the present invention.

FIG. 5 shows another embodiment of the present invention which differs from the abovementioned embodiment in that a differential pressure detector 55 is installed in the cutter head. The difference between the underground water pressure $P_1$ and the pressure $P_2$ inside the cutter drum 2 is detected by the differential pressure detector 55, the detection signal of which is sent to the controller 45.

The signal generated by the controller 45 controls or close the control valve 31 so as to obtain the relationship $P_1=P_2$ thereby keeping the slurry quantity $Q_2$ equal to the water supply quantity $Q_1$.

It is to be understood that the foregoing description is merely illustrative of preferred embodiments of the invention, and that the present invention is not to be limited thereto, but is to be determined by the scope of the appended claims.

What is claimed is:

1. A method of laying a pipe in the underground comprising the steps of:

(a) digging a departure and a arrival pit in the underground;

(b) laying a pilot pipeline of small diameter across said departure pit and said arrival pit;

(c) attaching a cutter head to the trailing end of said pilot pipeline, said cutter head having a cutter drum mounted thereto at the leading end thereof, diameter of said cutter drum being larger than that of said pilot pipeline and about equal to the diameter of the pipe to be laid;

(d) excavating earth and sand by said cutter drum and taking excavated earth and sand into an inside chamber of said cutter drum;

(e) supplying water into the chamber by utilizing said pilot pipeline to thereby convert the excavated earth and sand into a slurry state;

(f) discharging the slurried earth and sand into a tank provided in the arrival pit by utilizing said pilot pipeline;

(g) pushing the trailing end of said cutter head by a propulsion jack installed in the departure pit to thereby push said cutter head into the underground;

(h) connecting a pipe to be laid to the trailing end of said cutter head;

(i) repeating the steps (d) to (f) above; and (j) pushing the trailing end of said pipe to be laid by said propulsion jack to thereby push said pipe into the underground.

2. A method of laying a pipe in the underground according to claim 1, further comprising controlling the slurried earth and sand flow rate to be discharged to become approximately equal to a flow rate of water to be supplied.

3. A method of laying a pipe in the underground according to claim 1, further comprising detecting a pressure difference between the underground pressure at the cutter drum and a pressure in the inside chamber of the cutter drum, and controlling the pressure in the inside chamber to become approximately equal to the underground pressure at the cutter drum.

4. An apparatus for laying a pipe in the underground, comprising:

a pilot pipeline of a small diameter laid in the underground across a departure pit and a arrival pit;

cutter head means connected to the trailing end of said pilot pipeline, said cutter head means including means for excavating earth and sand and taking excavated earth and sand therein, the pipe to be laid being connectible to the trailing end of said cutter head means;

propulsion jack means installed in the departure pit to push the trailing end of said cutter head means or the trailing end of said pipe if connected to said cutter head means thereby propelling said cutter head means or a combination of said cutter head means and said pipe into the underground;

a first tank containing water therein;

water supply pipe means mounted to said pilot pipeline and connected to said first tank;

means formed in said cutter head means for converting the taken-in excavated earth and sand into a slurry state with the aid of water supplied from said water supply pipe means;

slurry discharge pipe means mounted to said pilot pipeline for discharging the slurried earth and sand from said cutter head means;

a second tank for receiving the slurried earth and sand from said slurry discharge pipe means; and a first pump for pumping water from said first tank and supplying the same to said water supply pipe means.

5. An apparatus according to claim 4 further comprising a second pump for pumping water from said second tank and supplying the same to said first tank.

6. An apparatus according to claim 4 further comprising flowmeter means mounted in said slurry discharge pipe means for detecting flow rate of the slurried earth and sand;

valve means disposed in said slurry discharge pipe means for restricting flow rate of the slurried earth and sand therethrough when actuated; and a controller responsive to said flowmeter means for controlling the rate of restriction of said valve means in such a way that flow rate of the slurried earth and sand becomes about equal to that of water supplied to said water supply pipe means.

7. An apparatus according to claim 4 further comprising first pinch valve means mounted within said slurry discharge pipe means for closing the same when fluid-operated;

second pinch valve means mounted within said water supply pipe means for closing the same when fluid-operated; and compressor means for selectively supplying compressed fluid to said first and second pinch valve means.

8. An apparatus according to claim 4 further comprising means for defining a receiving chamber in a leading end portion of said cutter head means;

differential pressure detector means mounted within said cutter head means for detecting pressure difference between underground pressure at said cutter head means and a pressure in said receiving chamber and generating a signal;

valve means disposed in said slurry discharge pipe means for restricting flow rate of the slurried earth and sand therethrough when actuated; and a controller responsive to the signal from said differential pressure detector means for controlling the rate of restriction of said valve means in such a way that the pressure in said receiving chamber becomes about equal to the underground pressure at said cutter head means.

* * * * *